US006821133B1

(12) United States Patent
Latal

(10) Patent No.: US 6,821,133 B1
(45) Date of Patent: Nov. 23, 2004

(54) PRINTED CIRCUIT BOARD MOUNTING CLIP AND SYSTEM

(75) Inventor: James F. Latal, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 343 days.

(21) Appl. No.: 09/703,818

(22) Filed: Nov. 1, 2000

(51) Int. Cl.[7] ..... H01R 4/66
(52) U.S. Cl. ..... 439/92
(58) Field of Search ..... 439/92, 65, 82, 439/876, 67, 553–554, 567, 78, 81, 84, 77, 884, 844, 493

(56) References Cited

U.S. PATENT DOCUMENTS 5,115,375 A * 5/1992 Garay ..... 439/82
5,135,403 A * 8/1992 Rinaldi ..... 439/81
5,267,125 A * 11/1993 Liu ..... 361/816
5,316,500 A * 5/1994 Vanaleck et al. ..... 439/567
5,322,452 A * 6/1994 Mosquera ..... 439/567
5,391,098 A * 2/1995 Ohashi ..... 439/572
5,401,188 A * 3/1995 Kosmala ..... 439/567
5,984,697 A * 11/1999 Moran et al. ..... 439/92

FOREIGN PATENT DOCUMENTS

EP 0 762 822 B1 7/1996
JP 3-50895 A 3/1991

* cited by examiner

*Primary Examiner*—P. Austin Bradley
*Assistant Examiner*—James R. Harvey
(74) *Attorney, Agent, or Firm*—Mark W. Croll; Paul F. Donovan

(57) ABSTRACT

A printed circuit board mounting system including a panel having an aperture, a mounting clip including a panel support end with a plurality of resilient fingers having corresponding end portions protruding radially outwardly from each other at non-perpendicular angles relative to the panel support end, the mounting clip having a circuit board support end spaced apart from the panel support end by an intermediate portion of the clip, the circuit board support end having a circuit board fastening portion, the plurality of fingers protruding through the panel aperture, some of the clip fingers frictionally engaged with the panel.

25 Claims, 2 Drawing Sheets

PRINTED CIRCUIT BOARD MOUNTING CLIP AND SYSTEM

BACKGROUND OF THE INVENTION

The invention relates generally to mounting clips, and more particularly to printed circuit board mounting and grounding systems and clips therefor.

An object of the present invention is to provide in some embodiments thereof novel printed circuit board mounting systems and mounting clips therefor that overcome problems in and improve upon the prior art.

Another object of the invention is to provide in some embodiments thereof novel printed circuit board mounting systems and clips therefor that are economical.

Another object of the invention is to provide in some embodiments thereof novel printed circuit board mounting systems and clips therefor that electrically interconnect a printed circuit board and a conductive panel, for example to provide an electrical grounding.

Another object of the invention is to provide in some embodiments thereof novel printed circuit board mounting systems and clips therefor that provide a space, or stand-off, between a printed circuit board and a panel or other member to which it is fastened.

A further object of the invention is to provide in some embodiments thereof novel printed circuit board mounting clips that may be manufactured economically.

A further object of the invention is to provide in some embodiments thereof novel printed circuit board mounting clips that are formed unitarily.

Another object of the invention is to provide in some embodiments thereof novel printed circuit board mounting clips that are formed from a metal stamping.

It is also an object of the invention to provide in some embodiments thereof novel printed circuit board mounting clips that are conductive, while in other embodiments the mounting clips are non-conductive.

A more particular object of the invention is to provide in some embodiments thereof novel printed circuit board mounting clips comprising a body member having opposite end portions interconnected in spaced apart relation by a side wall portion, a printed circuit board fastening portion disposed on one end portion of the body member, and a plurality of resilient fingers protruding from the other end portion of the body member opposite the end portion thereof having the printed circuit board fastening portion, the plurality of fingers each having a distal end portion diverging radially outwardly from each other at non-perpendicular angles relative to the end portion of the body member.

Another more particular object of the invention is to provide in some embodiments thereof novel unitary printed circuit board mounting clips comprising a plurality of resilient fingers protruding from a first support end thereof, the plurality of fingers each having a generally axially aligned portion extending from the first support end and a distal end portion diverging outwardly from the other distal end portions at non-perpendicular angles relative to the first support end, opposite side walls extending from corresponding portions of the first support end, a second support end opposite the first support end, the second support end spaced apart from the first support end by the opposite side walls, the first and second support ends being generally parallel support surfaces, the second support end comprising first and second end portions each extending from a corresponding one of the opposite side walls, and a printed circuit board fastening portion disposed on the second support end.

Still another more particular object of the invention is to provide in some embodiments thereof novel printed circuit board mounting systems comprising a panel having an aperture, a mounting clip comprising a panel support end with a plurality of resilient fingers having corresponding end portions protruding radially outwardly from each other at non-perpendicular angles relative to the panel support end of the clip, the mounting clip having a circuit board support end spaced apart from the panel support end by an intermediate portion of the clip, the circuit board support end having a circuit board fastening portion, the plurality of fingers of the clip protruding through the panel aperture, the clip frictionally engaged with the panel.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
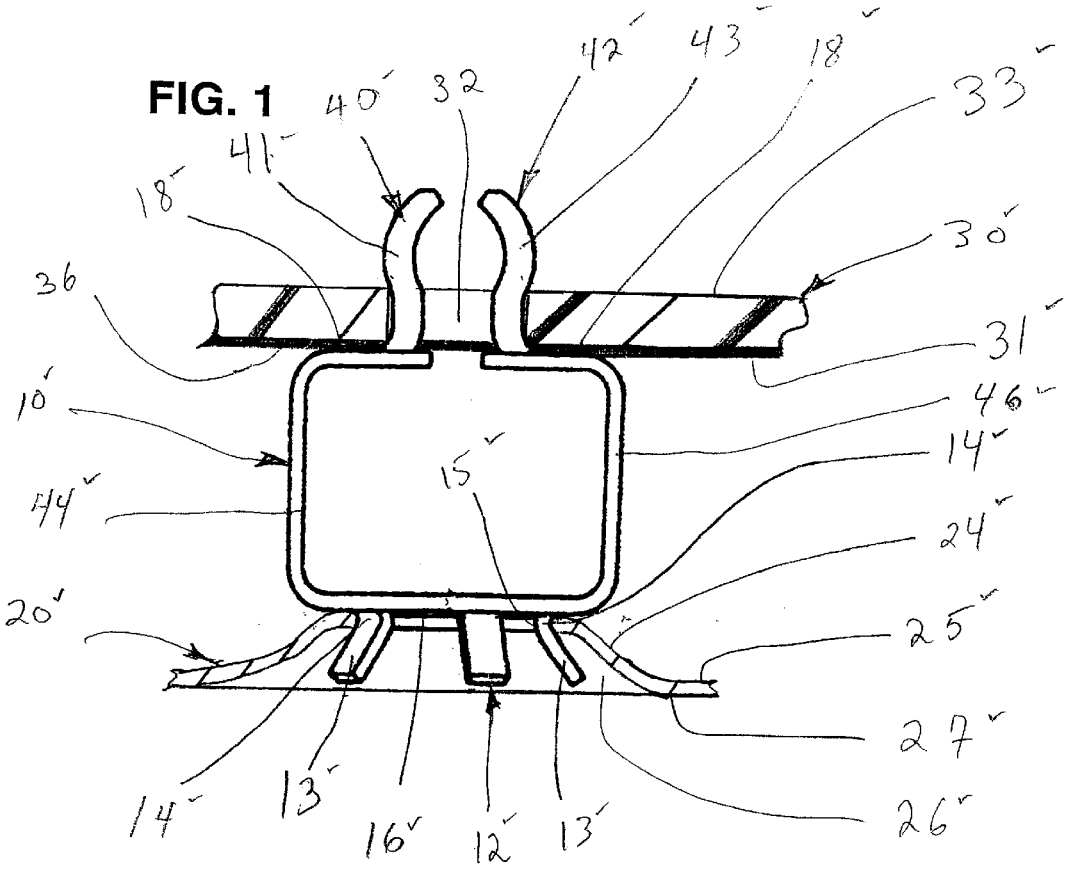
FIG. 1 is partial sectional view of an exemplary printed circuit board mounting system including an exemplary printed circuit board mounting clip.

FIG. 1 is a printed circuit board mounting system according to an exemplary embodiment of the invention. The system comprises generally an exemplary mounting clip 10 interconnecting a panel 20 and a printed circuit board 30 or some other members, the proportions of which are not necessarily drawn to scale.

The mounting clip generally comprises a circuit board support end spaced apart from a panel support end of the clip by an intermediate portion thereof. The panel support end of the clip includes a panel engagement portion for fastening to a panel, for example the chassis of a computer cabinet or some other panel. The circuit board support end of the clip includes a circuit board fastening portion for fastening to a printed circuit board or some other board.

Figure 3:
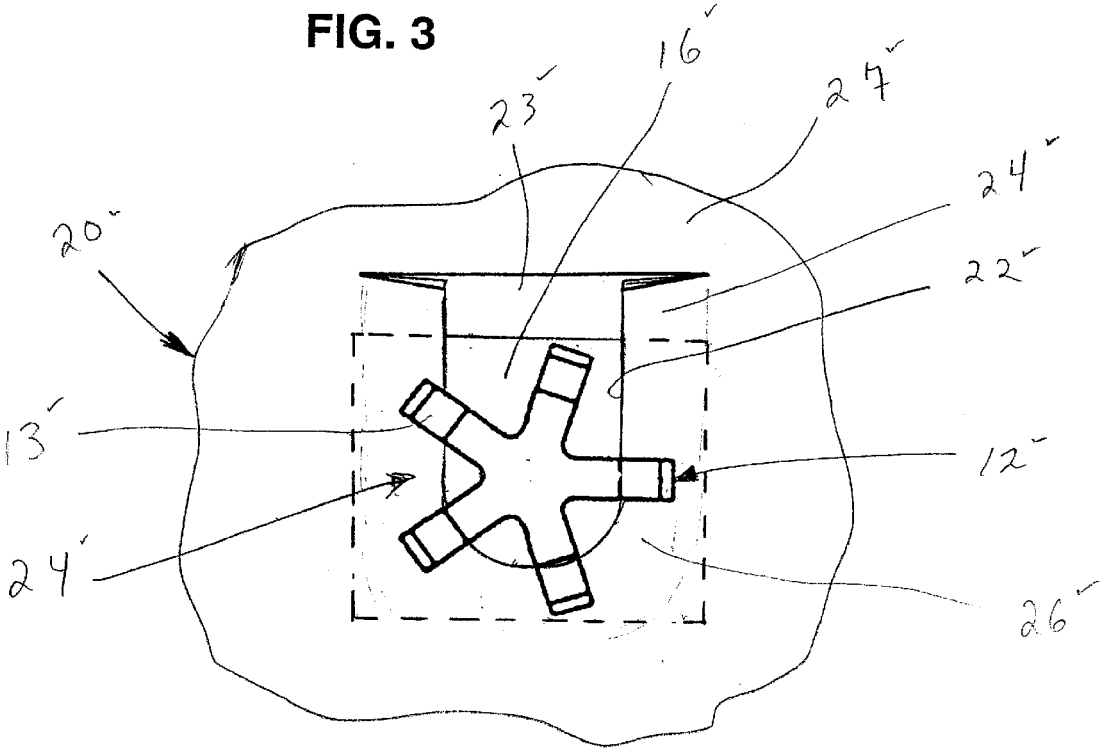
FIG. 3 is an end view of an exemplary mounting clip fastened to a panel.
Figure 4:
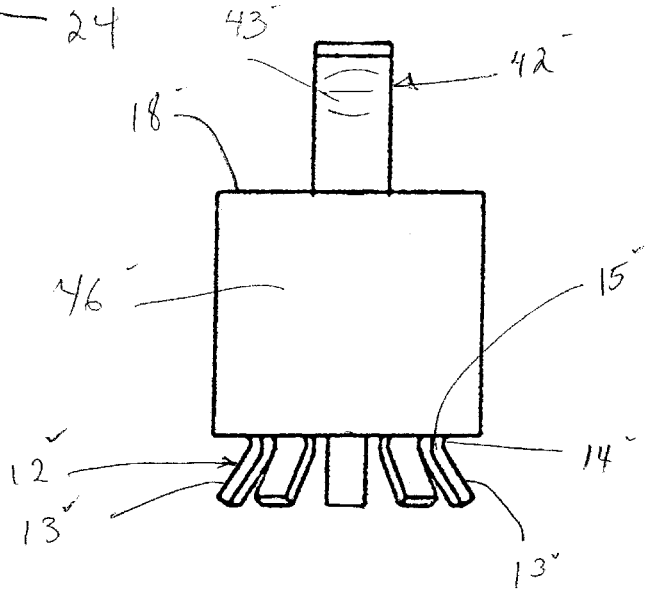
FIG. 4 is a side view of an exemplary mounting clip.

In FIGS. 1, 3 and 4, the exemplary panel engagement portion of the clip is in the form of a plurality of resilient fingers 12, only some of which are identified with numerals, having corresponding end portions 13 protruding radially outwardly from each other at non-perpendicular angles relative to the panel support end 16.

In one embodiment the plurality of fingers are arranged in star pattern, and in the exemplary embodiment of FIG. 3 there are five fingers in the pattern arranged symmetrically about a central axis, although other embodiments may include more than five fingers.

In FIGS. 1 and 4, the plurality of fingers 12 each also include a generally axially aligned portion 14 extending generally transversely from the panel support end 16 of the clip. In the exemplary embodiment the axially aligned portion 14 of each finger is distinguished from the corresponding diverging end portion 13 thereof by a bent portion 15 of the finger. In other embodiments the finger portions 13 and 14 are not discretely defined and instead are portions of a continuous arcuate finger protruding from the panel support end of the clip.

Figure 2:
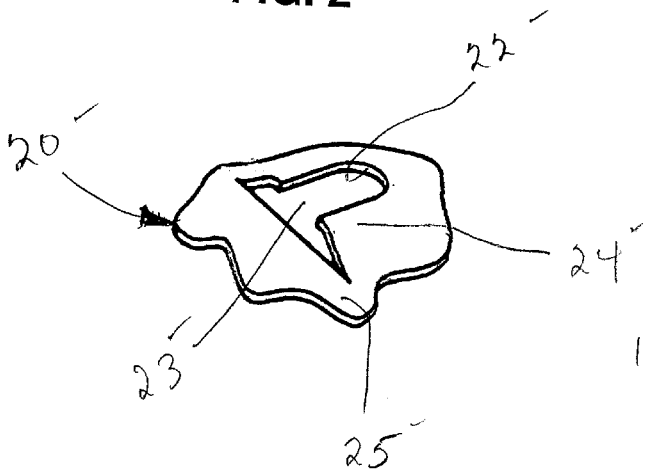
FIG. 2. is a partial view of a panel having an exemplary aperture configuration suitable for accommodating an exemplary mounting clip of the present invention.

In FIGS. 2 and 3, the panel 20 includes an aperture in the form of a generally U-shaped slot 22 with an open end 23 for engagement with the panel engagement portion of the clip, as discussed below. In FIGS. 1-3, the exemplary panel aperture is formed on a panel portion 24 that protrudes from a side 25 thereof thus forming a recess 26 on an opposite side 27 of the panel to accommodate the panel engagement portion of the mounting clip so that no portion of the clip protrudes beyond the side 27 of the panel, illustrated best in FIG. 1.

In other embodiments, the panel aperture may have other configurations and need not be formed on a portion of the panel protruding from a side thereof without the recess 26. The aperture may, for example, have a keyhole shape or rectangular shape with the open end disposed at an edge of the panel.

The panel aperture and protruding panel portion, if any, may be formed for example in stamping or other forming operations.

The plurality of resilient fingers of the exemplary mounting clip are configured to engage the panel aperture by sliding into the U-shape slot 22 from the open end 23 thereof. In other embodiments the panel engagement portion of the mounting clip may be configured differently to permit axially passage thereof through the panel aperture for subsequent engagement therewith.

In FIGS. 1 and 3, some of the resilient fingers 12 protruding from the mounting clip 10 are frictionally engaged with the panel 20. Particularly, as the resilient fingers are inserted into the slot, portions of the fingers engaged therewith tend to constrict slightly radially inwardly toward an each other, thereby applying an outwardly directed force on portions of the aperture. The panel 20 may also be wedged between the panel support end 16 of the clip and the fingers 12 engaged therewith as in the exemplary embodiment, depending on the configuration of the fingers.

In the exemplary system configuration of FIG. 3, the symmetric five fingered star pattern on the panel support end of the clip ensures that at least three of the fingers engage the exemplary U-shaped panel slot regardless of the rotational orientation of the star pattern relative thereto. Such a configuration may be desirable in applications where the mounting clips provides an electrical contact or interconnection between the panel and a conductive portion of the printed circuit board.

In FIG. 1, the printed circuit board fastening portion comprises first and second resilient arms 40, 42 extending generally axially from the circuit board support end 18 of the clip. The first and second resilient arms each have a corresponding bulbous portion 41, 43 protruding therefrom in spaced apart relation from the circuit board support end 18.

The printed circuit board 30 on one side 31 thereof is disposed on the circuit board support end 18 of the clip and the resilient arms 40 and 42 protrude into and through an opening 32 of the circuit board with the bulbous portions 41, 43 thereof engaged with the opposite side 33 of the circuit board. The resilient arms are flexible inwardly to permit the initial passage of the bulbous finger portions through the circuit board opening 32.

In FIG. 1, the panel and circuit board support end of the clip are interconnected by opposite side wall portions 44, 46 extending from corresponding sides of the panel support portion 16 of the clip from which the plurality of fingers protrude. In other embodiments, the opposite support ends of the clip may be spaced apart and interconnected by some other interconnecting structure of the clip.

Figure 5:
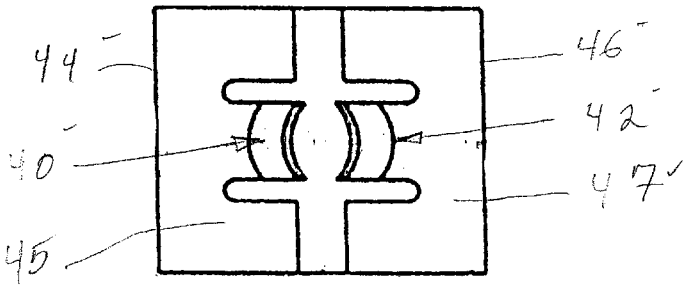
FIG. 5 is another end view of an exemplary mounting clip.

In the top view of FIG. 5, the first resilient arm 40 extends from a first end portion 45 of the circuit board support end of the clip and the second resilient arm 42 extends from a second end portion 47 of the circuit board support end of the clip. In the exemplary embodiment, the first and second end portions 45, 47 each extend from a corresponding one of the opposite side wall portions 44, 46, respectively.

As suggested above, in some embodiments the mounting clip 10 and the panel 30 are electrically conductive or have conductive portions, and the printed circuit board includes a conductive contact or portion 36 in electrical contact with the conductive mounting clip, which electrically interconnects the conductive panel and the conductive portion of the circuit board, for example for electrical grounding purposes.

The exemplary mounting clip 10 of the present invention is a unitary member formed of a conductive material, although it may be formed alternatively as an assembly of multiple components and/or of a non-conductive material.

In one embodiment, the clip is formed of a metal in a stamping and forming operation, wherein plurality of resilient fingers 12 and bulbous fingers of the printed circuit board fastening portion are stamped from the corresponding support ends of the clip.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A printed circuit board mounting clip comprising:

a body member having opposite end portions in spaced apart relation, the opposite end portions interconnected by a side wall;

a printed circuit board fastening portion disposed on one end portion of the body member;

a plurality of resilient fingers protruding from the other end portion of the body member opposite the end portion thereof having the printed circuit board fastening portion, the plurality of fingers each having a distal end portion diverging radially outwardly from each other at non-perpendicular angles relative to the end portion of the body member from which the plurality of fingers protrude.

2. The printed circuit board mounting clip of claim 1, the plurality of fingers arranged in star pattern.

3. The printed circuit board mounting clip of claim 2, the plurality of fingers including at least five fingers arranged symmetrically about an axis.

4. The printed circuit board mounting clip of claim 1 is a unitary metal article, the plurality of fingers stamped from the end portion of the body member, the interconnecting side wall having opposite side wall portions extending from corresponding sides of the end portion of the body member from which the plurality of fingers protrude.

5. The printed circuit board mounting clip of claim 1, the printed circuit board fastening portion comprising a bulbous portion spaced apart from the corresponding end portion of the body member.

6. The printed circuit board mounting clip of claim 5 is a unitary metal member, the interconnecting side wall including opposite side wall portions extending from corresponding sides of the end portion of the body member from which the plurality of fingers protrude.

7. The printed circuit board mounting clip of claim 1 is electrically conductive.

8. A unitary conductive printed circuit board mounting clip comprising:

a first support end;

a plurality of resilient fingers protruding from the first support end, the plurality of fingers each having a generally axially aligned portion extending from the first support end and a distal end portion diverging outwardly from the distal end portions of the other fingers at non-perpendicular angles relative to the first support end;

opposite side walls extending from corresponding portions of the first support end;

a second support end opposite the first support end, the second support end spaced apart from the first support end by the opposite side walls, the first and second support ends being generally parallel support surfaces, the second support end comprising first and second end portions each extending from a corresponding one of the opposite side walls;

a printed circuit board fastening portion disposed on the second support end.

9. The unitary conductive printed circuit board mounting clip of claim 8, the printed circuit board fastening portion comprising first and second resilient arms extending generally axially from the second support end of the clip, the first resilient arm extending from the first end portion of the second support end and the second resilient arm extending from the second end portion of the second support end.

10. The unitary conductive printed circuit board mounting clip of claim 9, the first and second resilient arms have a bulbous portion.

11. The unitary conductive printed circuit board clip of claim 8 is metal stamping.

12. The unitary conductive printed circuit board clip of claim 8, the plurality of fingers arranged symmetrically in star pattern.

13. The unitary conductive printed circuit board clip of claim 12 is metal, the plurality of fingers are stamped from the first support end of the clip.

14. A printed circuit board mounting system comprising:

a panel having an aperture;

a mounting clip comprising a panel support end with a plurality of resilient fingers having corresponding end portions protruding radially outwardly from each other at non-perpendicular angles relative to the panel support end of the clip, the mounting clip having a circuit board support end spaced apart from the panel support end by an intermediate portion of the clip, the circuit board support end having a circuit board fastening portion;

the plurality of fingers protruding through the panel aperture, some of the fingers protruding from the clip frictionally engaged with the panel.

15. The system of claim 14, the mounting clip is a unitary metal member, the plurality of fingers stamped from the panel support end of the clip, the intermediate portion of the clip comprising opposite side wall portions extending from corresponding portions of the panel support end.

16. The system of claim 15, the circuit board support end of the mounting clip comprising first and second end portions each extending from a corresponding one of the opposite side wall portions, the circuit board fastening portion comprising a first resilient arm extending from the first end portion of the circuit board support end and the second resilient arm extending from the second end portion of the circuit board support end.

17. The system of claim 14, the circuit board fastening portion comprising a bulbous portion.

18. The system of claim 17, the mounting clip and the panel are electrically conductive.

19. The system of claim 18, a printed circuit board having an aperture and a conductive portion thereon, the printed circuit board fastening member disposed through the printed circuit board aperture, the printed circuit board disposed between the bulbous portion of the circuit board fastening portion and printed circuit board support end of the clip, the conductive portion of the printed circuit board contacting the conductive clip.

20. The system of claim 14, the panel aperture including a U-shaped slot portion with an open end on a portion of the panel protruding from one side thereof.

21. A printed circuit board mounting system comprising:

a panel having an aperture;

a mounting clip comprising a panel support end with a plurality of resilient fingers having corresponding end portions protruding radially outwardly from each other at non-perpendicular angles relative to the panel support end of the clip, the mounting clip having a circuit board support end spaced apart from the panel support end by an intermediate portion of the clip, the circuit board support end having a circuit board fastening portion;

the panel support end of the mounting clip disposed on one side of the panel, the plurality of fingers protruding through the panel aperture to a side of the panel opposite side thereof on which the mounting clip is disposed, end portions of at least some of the fingers extending radially outwardly of the aperture on the opposite side of the panel, whereby the mounting clip is frictionally engaged with the panel.

22. The system of claim 21, the aperture of the panel is a U-shaped slot with an open end, the aperture is disposed on a recessed portion of the panel.

23. The system of claim 21, the circuit board fastening portion of the mounting clip comprising a bulbous portion.

24. The system of claim 23, the clip and the panel comprise electrically conductive materials in electrical contact with each other.

25. The system of claim 24, a printed circuit board having an aperture and a conductive portion thereon, the bulbous portion of the mounting clip disposed through the printed circuit board aperture, the printed circuit board disposed between the bulbous portion and the printed circuit board support end of the mounting clip.

* * * * *

UNITED STATES PATENT AND TRADEMARK OFFICE

CERTIFICATE OF CORRECTION

PATENT NO. : 6,821,133 B1
DATED : November 23, 2004
INVENTOR(S) : James F. Latal It is certified that error appears in the above-identified patent and that said Letters Patent is hereby corrected as shown below:

Column 4,
Line 44, delete the preamble, and in its place, insert the following:
-- A mounting clip for a printed circuit board, the mounting clip comprising: --
Line 59, after "protrude", insert the following:
-- , such that the distal end portions extend generally downwardly away from the printed circuit board --

Column 5,
Line 30, after "support surfaces,", insert the following:
-- such that the first support end, the second support end and the side walls are arranged and configured in such a manner so as to create a box like structure, --
Line 66, after "through" and before "the", insert the following: -- and downwardly away from --

Column 6,
Line 48, delete "of".
Line 48, after "outwardly", insert the following: -- and downwardly from --

Signed and Sealed this

Twenty-fifth Day of January, 2005

JON W. DUDAS
*Director of the United States Patent and Trademark Office*